United States Patent [19]

Bodine

[11] Patent Number: 4,817,712

[45] Date of Patent: Apr. 4, 1989

[54] ROD STRING SONIC STIMULATOR AND METHOD FOR FACILITATING THE FLOW FROM PETROLEUM WELLS

[76] Inventor: Albert G. Bodine, 7877 Woodley Ave., Van Nuys, Calif. 91406

[21] Appl. No.: 173,248

[22] Filed: Mar. 24, 1988

[51] Int. Cl.[4] ..... E21B 43/25; F04F 7/00

[52] U.S. Cl. ..... 166/249; 166/104; 166/177; 175/56; 417/241

[58] Field of Search ..... 166/249, 304, 104, 177; 175/56; 417/241

[56] References Cited

U.S. PATENT DOCUMENTS

| | | | |
|---|---|---|---|
| 2,667,932 | 2/1954 | Bodine | 166/177 |
| 3,952,800 | 4/1976 | Bodine | 166/249 |
| 4,342,364 | 8/1982 | Bodine | 166/104 |
| 4,358,248 | 11/1982 | Bodine | 417/241 |
| 4,487,554 | 12/1984 | Bodine | 417/241 |
| 4,673,037 | 6/1987 | Bodine | 166/177 |
| 4,716,555 | 12/1987 | Bodine | 166/249 |

*Primary Examiner*—Jerome W. Massie

*Assistant Examiner*—Terry L. Melius

*Attorney, Agent, or Firm*—Edward A. Sokolski

[57] ABSTRACT

A close fitting piston of a material such as rubber is attached to the end of a rod string such as a sucker rod which is suspended inside a tubing string installed in an oil well. An orbiting mass oscillator is attached to the upper end of the rod string and is operated at a frequency such as to cause resonant standing wave vibration of the rod string. The piston member attached to the bottom end of the rod string is driven by the vibrational energy to in effect form an acoustical piston which is driven by the vibrational energy. This energy is coupled to the surrounding liquid and thence to the surrounding formation to effectively unclog the well and the casing string of contaminants which may be impeding the flow of effluent from the well. The piston means is made long enough so that it operates as an acoustic monopole with both ends of the piston being vibrationally in phase with the vibrational energy traveling in the surrounding liquid medium.

7 Claims, 3 Drawing Sheets

ROD STRING SONIC STIMULATOR AND METHOD FOR FACILITATING THE FLOW FROM PETROLEUM WELLS

This invention relates to a method and apparatus for stimulating the flow of effluent from a petroleum well and more particularly to such a method and apparatus which employs sonic energy to facilitate the removal of contaminants clogging the surrounding earthen formation and the casing screen.

With the passage of time, the earthen formations in oil wells tend to become clogged with contaminants and earthen debris This problem can become particularly serious because petroleum carries a wide range of contaminants such as wax and tar which tend to block up the pores of the earthen structure. Such contaminants also tend to clog up the gravel pack installed around the bottom of the oil well casing string as well as the perforations in the casing string through which the effluent is produced. Various techniques and apparatus for alleviating this problem are described in my U.S. Pat. Nos. 2,667,932, 2,700,422, Re. 23,381, 2,871,943, 2,680,485, 3,004,601 and 3,952,800.

The system of the present invention is an improvement over such prior art systems in that it is adapted to operate with the well pumping mechanism in situ, i.e, without the need for removing the pumping system from the well. The present system therefore can be operated either at frequent intervals with the pumping temporarily suspended or it can be applied continually along with the pumping operation. This greatly economizes and facilities the operations involved and with the frequent use of the present system thus made feasible, contamination can be more easily prevented.

The system of the invention is particularly adapted to operate with the sonic pump of my U.S. Pat. No. 4,487,554 issued Dec. 11, 1984 and the preferred embodiments of the invention are described in conjunction with the pumping apparatus of my '554 patent. The disclosure of my U.S. Pat. No. 4,487,554 is incorporated herein by reference.

Briefly described the system of the present invention utilizes a piston which may be of a material such as rubber which is attached to the lower end of a rod string which may comprise a sucker rod. The rod string is driven at a sonic frequency to effect resonant standing wave vibration thereof by means of an orbiting mass oscillator attached to the upper end of the string. The rod string is suspended in a tubing string forming a conduit which is installed within an oil well. Mounted on the rod string are a series of sonically responsive impeller pump elements which operate to drive fluid from the well up the tubing string. The close fitting member attached to the bottom end of the rod string forms an acoustical piston and has a length relative to the vibration frequency of the rod string such that it operates as a monopole with regard to the surrounding liquid medium, i.e. the opposite ends of the piston have substantially the same phase relationship with the sound travelling in the liquid at their interface therewith. Thus, each end of the piston acts as a monopole and the intervening length of the piston provides an acoustical baffle effect from the extended length of filled out coverage afforded the imaginary back side of each piston surface at the end thereof. In practice, maximum transfer of energy from the piston to the liquid medium can be attained by adjusting the frequency of the orbiting mass oscillator until there is maximum power loading of the drive for the oscillator, indicating that maximum energy is being delivered to the piston and the fluid body.

It is therefore an object of this invention to provide an efficient system for removing contaminants from an oil well and the tubing string therefore.

It is a further object of the invention to enable the operation of a mechanism for unclogging contaminants in an oil well and its associated tubing string while the oil well pumping mechanism is in situ.

Other objects of the invention will become apparent as the description in connection drawings of which:

Figure 1:
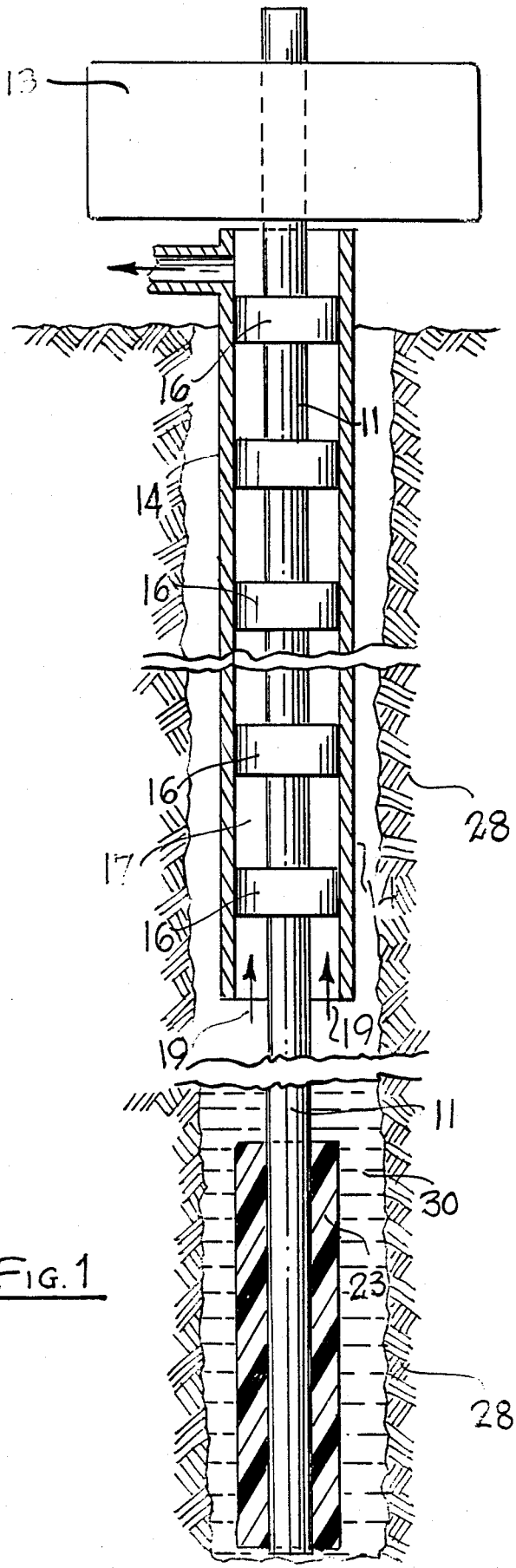
FIG. 1 is a cross sectional view in elevation of a first embodiment the invention.
Figure 1:
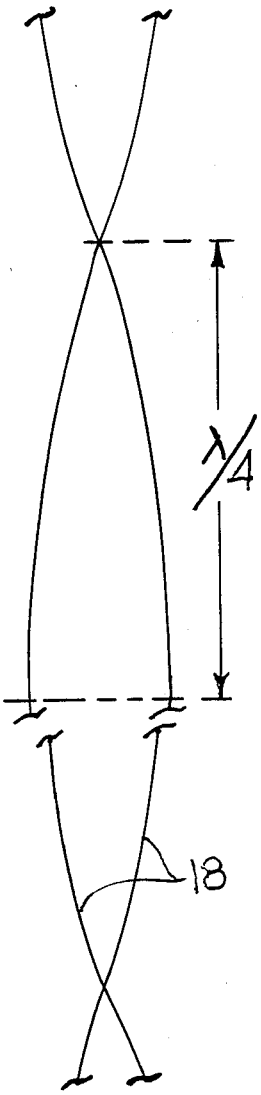

Referring now to FIG. 1, a first embodiment of the invention is illustrated. Except for piston 23 attached to the bottom end of rod string 11 this embodiment employs the same structure described in my U.S. Pat. No. 4,487,554 which is incorporated herein by reference. Therefore this common structure will be but briefly described.

Rod string 11 is suspended from vibration generator 13 which may comprise an orbiting mass oscillator and an appropriate rotary drive mechanism. Rod 11 is solid and fabricated of a highly elastic material such as steel. The rod is suspended freely within tubing 14 which is installed in an oil well in earthen formation 27. A plurality of sonic fluid impeller units 16 are mounted on rod 11 at spaced intervals therealong, an annulus 17 being formed between the inner wall of tubing 14 and the outer wall of rod 11. In its normal pumping operation, oscillator 13 is operated at a frequency such as to set up resonant standing wave vibration of rod string 11 as indicated by graph lines 18. This causes impellers 16 to pump effluent up through tubing 14 as indicated by arrows 19 and out of the well through outlet 15. The details of the structure thus far alluded to are thoroughly described in my U.S. Pat. No. 4,487,554.

Cylindrical resilient piston member 23 which may be of rubber is fixedly attached to the end of rod 11 as, for example, by vulcanizing. The outside diameter of piston 23 is such as to provide a slip fit inside of the tubing 14. As shown in FIG. 1, normal pumping operation is in effect with the effluent being pumped out of the well as described in my aforementioned '554 patent. Piston 23 has sufficient length so as not to present an acoustical dipole in the liquid 30 at the operating frequency of oscillator 18, i.e. the piston has sufficient length (at least several feet and typically six feet) so that each end acts in the liquid as a monopole and the intervening portion of the acoustical piston provides an acoustical baffle effect for each substantially monopole end. This end result can be assured by adjusting the frequency of the oscillator 18 so that substantially more power loading of the oscillator drive is evidenced than in the case of normal pumping by itself. This evidences that substantial power is being coupled to the piston and radiated through the liquid into the formation. It has been found that a six foot length for piston 23 operates quite effectively with a gas permeated liquid at an operating frequency of 20 Hz.

Thus in the mode of operation of the invention illustrated in FIG. 1, normal pumping of effluent is being achieved through tubing string 14 while simultaneously high level sonic energy is being coupled to the formation through liquid 30 to free contaminants trapped in the formation.

Figure 2:
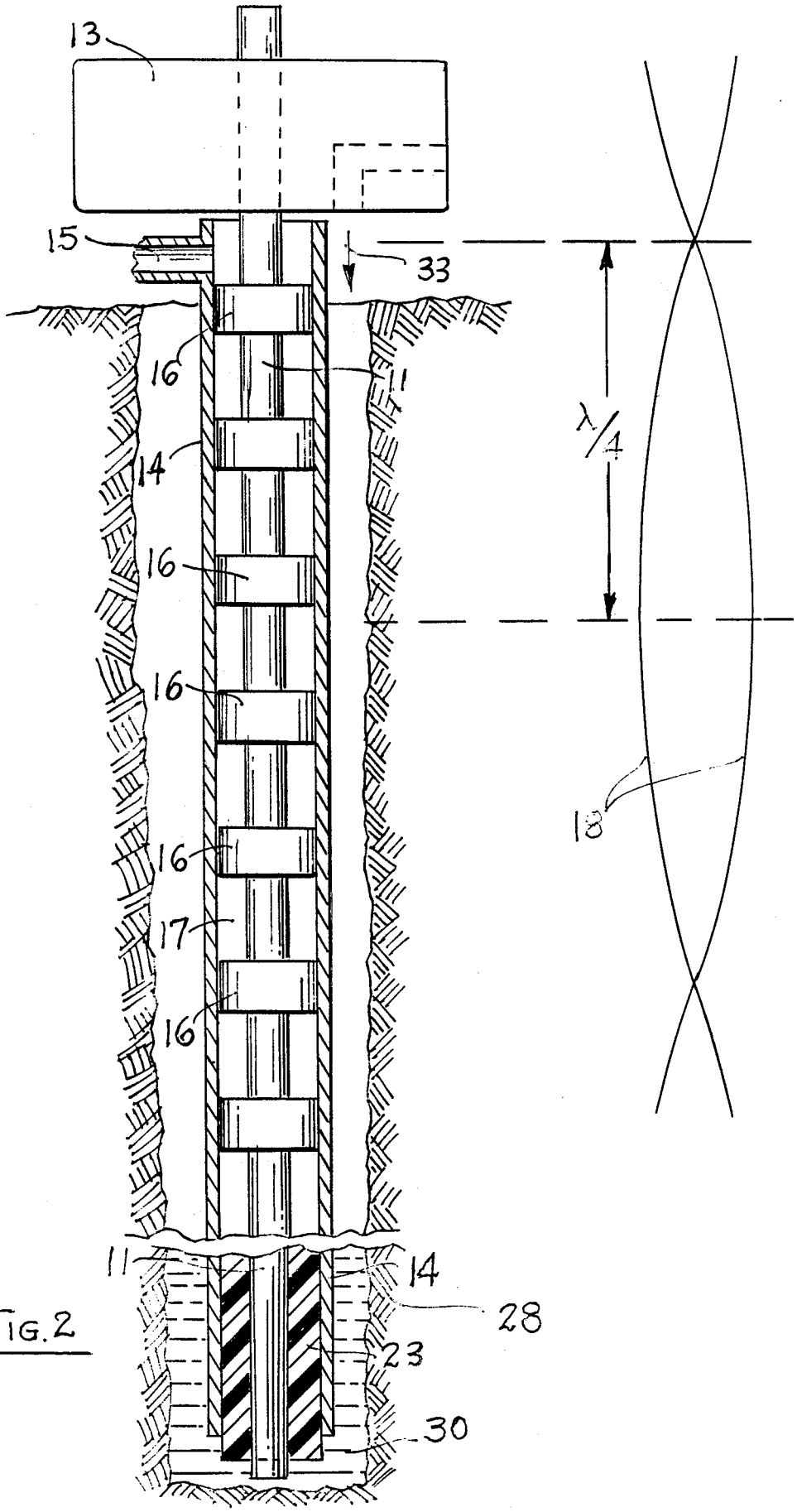
FIG. 2 is a cross sectional view in elevation of the first embodiment of invention in a different mode of operation from that of FIG. 1.

Referring now to FIG. 2 a second mode of operation of the invention is illustrated. In this mode of operation, piston 23 is withdrawn upward and within tubing 14 to seal off the bottom of the tubing. In this mode of operation, the pumping operation is terminated in view of the fact that the end of tubing 14 is now sealed off. Tubing 14 now operates like an infinite acoustical baffle for piston 23 with the bottom end of the piston acting to radiate the energy into the liquid 30 and thence to the surrounding formation. In this embodiment, all of the acoustical energy available is coupled from the piston to the formation so that a maximum amount of energy is delivered to such formation for removing the contaminants therefrom.

To enhance the removal of the contaminants, a penetration liquid can be introduced into the annulus surrounding tubing 14 as indicated by arrow 33. This penetration liquid is driven into the earthen formation by agitation of the piston. A typical such penetration liquid which may be used is organic detergent or diesel fuel. After a desired amount of penetration liquid has been driven into the formation, rod 11 can be lowered to bring piston 23 back to the position shown in FIG. 1. The sonic pumping operation is then resumed to bring the penetration liquid and contaminants out of the formation. The piston can then be left in the position shown in FIG. 1 to continually operate to remove contaminants while the pumping operation is going on.

Figure 3:
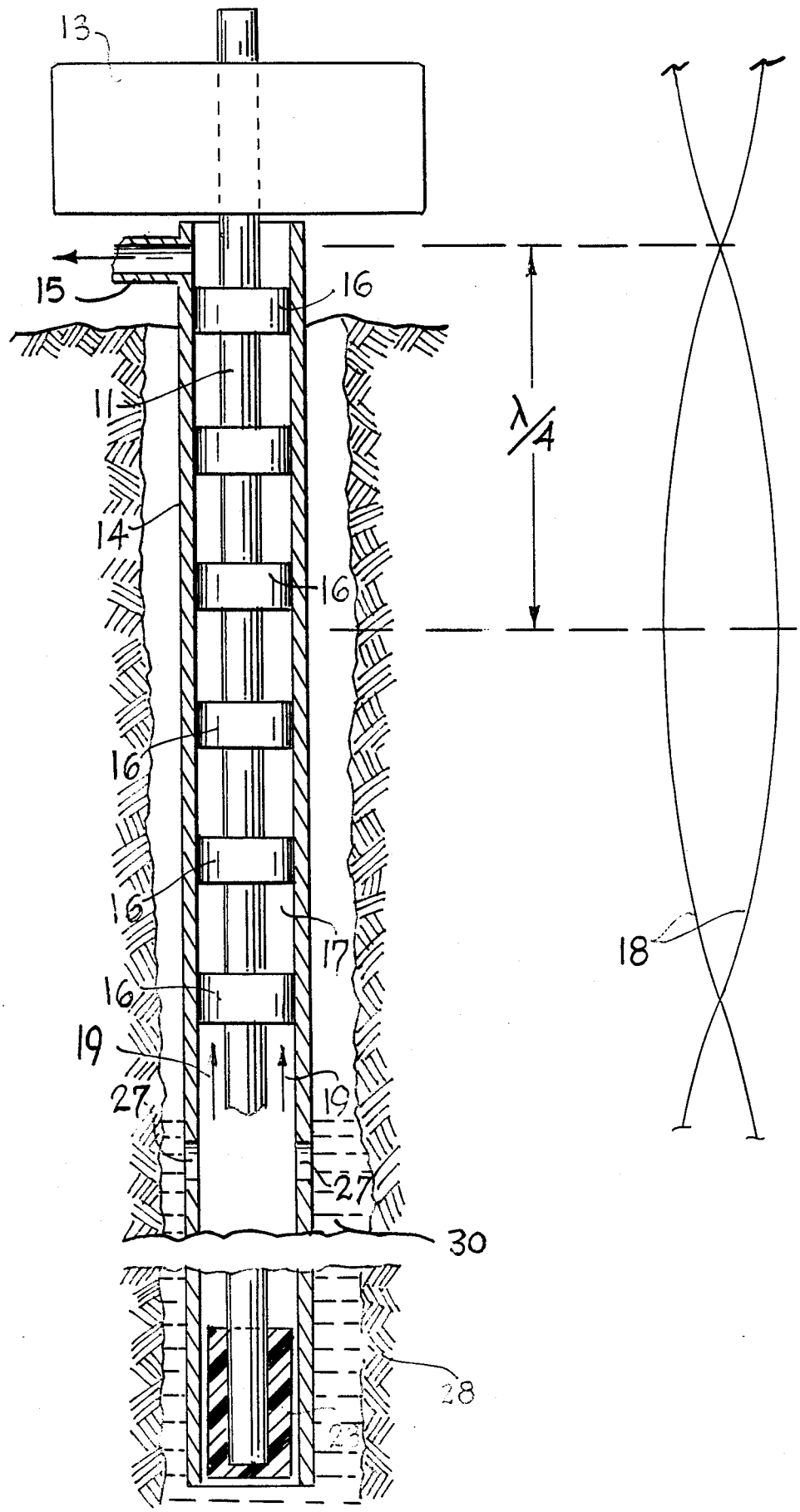
FIG. 3 is a cross sectional view in elevation of a third embodiment of the invention.

Referring now to FIG. 3, a second embodiment of the invention is illustrated. In this embodiment, the piston 23 is vulcanized to the end of rod 11 and contained with close fit within tubing 14 so that the tubing provides an acoustical baffle for the piston. As in the prior embodiment the piston operates as an acoustical monopole. In this embodiment, ports 27 are provided in tubing 14 to permit the entry of effluent into tubing 14 for pumping to the surface while piston 23 is simultaneously being used to provide sonic energy to free contaminants from the surrounding formation. In this embodiment, the distance from the top of piston 23 up the inside of the pipe through ports 27 down the outside of the pipe to the bottom of the piston should be at least 1/10th of the wave length for the speed of sound in liquid 30 at the highest operating frequency of oscillator 13. Typically, this distance is at least six feet in most installations. Using such a distance avoids the problem of pressure pulses from the top and bottom surfaces of the piston arriving at the same point in 180° phase relationship and thus cancelling each other out. In this embodiment the piston need not be especially long because the tubing provides the acoustic baffle function.

While the invention has been described and illustrated in detail, it is to be clearly understood that this is intended by way of illustration and example only and is not to be taken by way of limitation, the spirit and scope of the invention being limited only by the terms of the following claims.

I claim:

1. In a petroleum well pumping system for pumping liquid out of said well having a tubing string running down the well, a rod string of an elastic material within and running along said tubing string, vibration generator means for providing vibrational energy to said rod string at a frequency such as to effect resonant standing wave vibration thereof, and a plurality of sonic impeller elements mounted on said rod string at spaced intervals therealong, the improvement being means for unclogging and removing contaminants from the earthen formation surrounding the well and from perforations in the tubing string comprising:

a piston member attached to the bottom end of said rod string, said piston member being immersed in the liquid in said well and being driven by said vibrational energy, said piston member radiating said energy into the liquid and thence to said formation to free contaminants therein, said piston member being dimensioned so as to operate as a monopole in said liquid at the frequency of said vibrational energy.

2. The system of claim 1 wherein said piston member is of a resilient material and has a diameter such as to slip fit into said tubing string, said piston member being adapted to be positioned either in said liquid entirely outside said tubing directly below the bottom end thereof or within said tubing.

3. The system of claim 1 wherein said piston member is mounted within the bottom end of said tubing.

4. A sonic method for removing contaminants from an earthen formation surrounding the bottom of an oil well having a liquid therein, comprising:

installing a tubing string within said well, installing a rod string of elastic material within said tubing string, running therealong, installing pump means for pumping liquid along said tubing string, attaching a piston member to the bottom end of said rod string, said piston member being in contact with said liquid, and coupling sonic energy to said rod string, said energy being at a frequency such as to effect resonant standing wave vibration of said rod string, said sonic energy sonically driving said piston member, said piston member being dimensioned so as to operate as a monopole in said liquid when sonically driven, said piston member radiating the energy into the liquid and thence into said earthen formation to free contaminants therefrom.

5. The method of claim 4 wherein said piston is suspended outside of said tubing string below the bottom end thereof, the sonic energy simultaneously driving both said pump means to pump liquid up said well and said piston member.

6. The method of claim 4 wherein said piston member is drawn within said tubing string to close the bottom end thereof such that all of the available sonic energy is employed to drive said piston member.

7. The method of claim 5 wherein a penetration liquid is fed along the outside wall of said tubing string to the bottom end of said well, said penetration liquid being sonically driven into the earthen formation.

* * * * *